United States Patent [19]

Baltensperger et al.

[11] 4,208,969

[45] Jun. 24, 1980

[54] SUSPENDED RAIL STRUCTURE ESPECIALLY FOR MONORAIL VEHICLES

[76] Inventors: Rudolf Baltensperger, Alte Kaiserstuhlstr. 157, CH 8181 Höri, Switzerland; Hans B. Pfister, Frohhaldenstrasse 20, CH 8180 Bülach, Switzerland

[21] Appl. No.: 906,854

[22] Filed: May 17, 1978

[30] Foreign Application Priority Data

May 17, 1977 [CH] Switzerland ..... 6131/77

[51] Int. Cl.[2] ..... E01B 25/22

[52] U.S. Cl. ..... 104/111; 14/18; 104/106; 104/123; 191/41

[58] Field of Search ..... 104/87, 89, 93, 106, 104/110, 111, 112, 115, 123; 191/41; 248/55, 571; 14/18, 19, 20, 22; 404/1; 188/1 B; 267/141, 57.1 R

[56] References Cited

U.S. PATENT DOCUMENTS

| | | | |
|---|---|---|---|
| 626,783 | 6/1899 | Dusedau | 104/115 |
| 3,168,270 | 2/1965 | Bligard et al. | 267/57.1 R |
| 3,604,361 | 9/1971 | Harbert et al. | 104/123 |
| 3,626,856 | 12/1971 | Goodell | 104/89 |
| 3,690,266 | 9/1972 | Mayo | 104/89 X |
| 3,753,406 | 8/1973 | Müller | 104/123 X |
| 3,872,950 | 3/1975 | Ashfield et al. | 188/1 B |
| 4,069,765 | 1/1978 | Müller | 104/123 |

FOREIGN PATENT DOCUMENTS

| | | | |
|---|---|---|---|
| 1011447 | 7/1957 | Fed. Rep. of Germany | 104/89 |
| 601560 | 7/1978 | Switzerland | 104/123 |

*Primary Examiner*—Randolph A. Reese
*Attorney, Agent, or Firm*—Karl F. Ross

[57] ABSTRACT

A suspended rail assembly, especially for monorail vehicles, comprises a plurality of support masts bridged by a suspension cable from which a rail is supported by suspenders. In an unloaded state, an upward bow is imparted to the rail and each mast is provided with a beam elastically mounted therein and pivotal about a horizontal axis perpendicular to the rail for rounding out the rail.

10 Claims, 9 Drawing Figures

SUSPENDED RAIL STRUCTURE ESPECIALLY FOR MONORAIL VEHICLES

FIELD OF THE INVENTION

The present invention relates to a rail assembly and, more particularly, a suspended rail assembly of the type used for monorail vehicles, cable cars and the like.

BACKGROUND OF THE INVENTION

It is known to provide overhead rail systems upon which a vehicle can be mounted for the transport of goods, people, etc. Generally such an assembly comprises a plurality of uprights, i.e. support masts or pylons, spanned by the relatively rigid rail upon which the vehicle is adapted to ride.

In another system, the rails are suspended from a support cable which can be slung between the support masts where, for example, suspenders hang vertically from the suspension cable to engage the rail. Such systems have been made and marketed by Eberfeld-Barmen, GERMANY, and can span distances of several hundred meters between support masts or posts as opposed to distances of only 10 to 15 meters where rigid rail structures are employed.

However, while cable-supported rails can span far greater distances than rigid rails, the vehicle speed in cable-suspended rails must be low. This is because of the downward bow of the rail between the supports and the crowning of the wire upwardly in the region of the supports.

The sag of the cable between the support masts or pylons has previously been the subject of investigation and it has been proposed (see German open application-Offenlegungsschrift—DT-0S 2 149 871) to provide a negative sag, i.e. an upward bow, which will compensate for the load applied by the vehicle so that the vehicle travels only over a straight line stretch into which the rail is deflected against the contrary loading necessary to bring about the negative sag. The travel path is thus approximately straight. In spite of the fact that the sag during travel appears to be eliminated by this technique, experiments with it have shown that it does not have the desired effect, namely, does not allow a substantial increase in speed.

In that prior-art system the "track" is a wire or cable from which the vehicle is suspended. In German open application—Offenlegungsschrift-DT-0S 1 905 686, the track-forming cable is replaced by a rail which is suspended in the manner described previously so that stretches of the rail between the masts or pylons are bowed upwardly. All of these systems have the aforementioned negative sag whether the track is in the form of a cable or rail. Also all have the disadvantage that, in an unloaded state of the track, at the masts or posts, crimps are formed in the track in the regions in which it is suddenly deflected upwardly by the negative sag arrangement. This is because at the pylons or masts, a downward reaction force must be applied to the track to keep the same from moving upwardly to follow the upward prestress inducing the negative sag.

Even when the vehicle is traveling along the track so that its load balances the upward force producing the upward sag, the crimping of the track at the support or pylon remains. In this region the vehicle must make a transition between the loaded and unloaded stretches of the track. The crimped parts of the track reduce the maximum speed which can be developed therealong, give rise to excessive wear and, in general, have been found to be unsatisfactory.

OBJECTS OF THE INVENTION

It is the principal object of the present invention to provide an improved suspended track assembly, especially for monorail vehicles and the like, which permits high speed and stability of operation of the vehicle.

Another object of the invention is to provide a system which has the advantage of the rail arrangement constituting the track but yet is free from the disadvantages of such systems while retaining the advantages of the track-forming cable system.

SUMMARY OF THE INVENTION

These objects and others which will become apparent hereinafter are attained, in accordance with the present invention, by providing a suspended-track assembly, especially for monorail and like vehicles, which comprises a plurality of spaced-apart masts spanned by a suspension cable from which between the masts, suspenders hang downwardly and engage a beam-type track or rail upon which the vehicle is displaced, the suspenders, cable and rail being dimensioned such that the rail is upwardly bowed between masts in an unloaded state but, in a loaded state, has its upward prestress balanced by the load force so as to travel practically on a straightaway.

According to the invention at least one guide beam is provided at each mast and is pivotally connected thereto while acting upon the rail to round out the latter and prevent crimping. This beam or bar is pivotally secured to the mast for swinging movement about an axis perpendicular to the rail axis.

According to another feature of the invention, elastic (rubber) means is provided between the pivot pins of the rail and the housing of the mast to enable the beam or bar to undergo limited movement parallel to the pivot axis, perpendicular to the pivot axis in two mutually perpendicular directions, and in torsion about the longitudinal axis of the rail and the axis of the pivot pin.

According to still another feature of the invention, the beam and the rail are formed with abutments separable to permit a predetermined maximum positive or negative sag to develop.

Guide means can be provided between each end of the beam and the proximal portion of the rail so that the rail can ride along the beam independently of its sag.

Another feature of the invention is to provide cable means spanning the rail along its entire length approximately parallel to the rail axis for stiffening the rail.

SPECIFIC DESCRIPTION

The above and other objects, features and advantages of the present invention will become more readily apparent from the following description, reference being made to the accompanying drawing in which.

SPECIFIC DESCRIPTION

Figure 1:
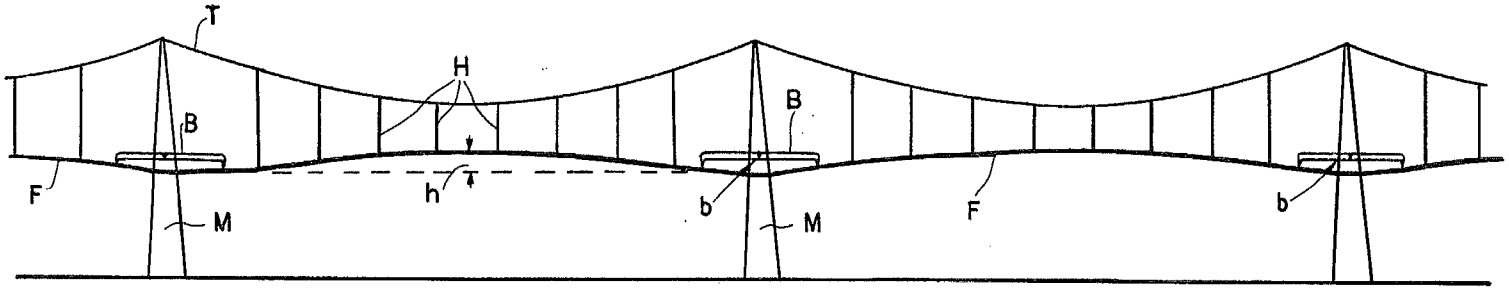
FIG. 1 is a diagrammatic side-elevational view of a suspended rail system according to the invention.

FIG. 1 shows a portion of a rail system according to the present invention, the system being usable by a monorail vehicle or other vehicle suspended from the rail member F itself. Such systems may be used not only for travel along the horizontal (as shown in FIG. 1) but for above-surface transport between low and high points as may be required.

A system comprising a plurality of support masts M, or pylons, is bridged by a suspension cable T which can be connected to the tops of the pylons M. Suspenders H run vertically from the cable T to the rail F. The suspenders H are so dimensioned that the rail F in the unloaded state, assumes a negative bow, i.e. is bowed upwardly (see FIG. 1). When normally loaded, e.g. by the vehicle, the entire system is stressed and in addition the rail F lies along a straight line.

In each of the support masts or pylons M, there is provided a pivotal guide beam B. Each beam B is pivotally connected at its center with the mast M so that it bears, at its ends, upon the upwardly bowed stretches of the rail F to either side of the mast M. The pivotal connection to the mast will be described in greater detail in connection with FIGS. 4 through 6. The beam serves to round off the rail and prevent kinking or crimping to either side of the mast.

The rail F, which can be constituted from two square-cross section tubes joined together by webs, should have a greater flexibility or less stiffness than the beam B. Each beam B comprises a pair of U-channels $B_1$, $B_2$ welded to opposite sides of a rectangular profile $B_3$. As can be seen from FIG. 3, moreover, the rails are composed of square tubing 7 joined together by webs 71. The rail is further stiffened by tensioning cables as will be discussed in connection with FIGS. 7 and 8.

Figure 2:
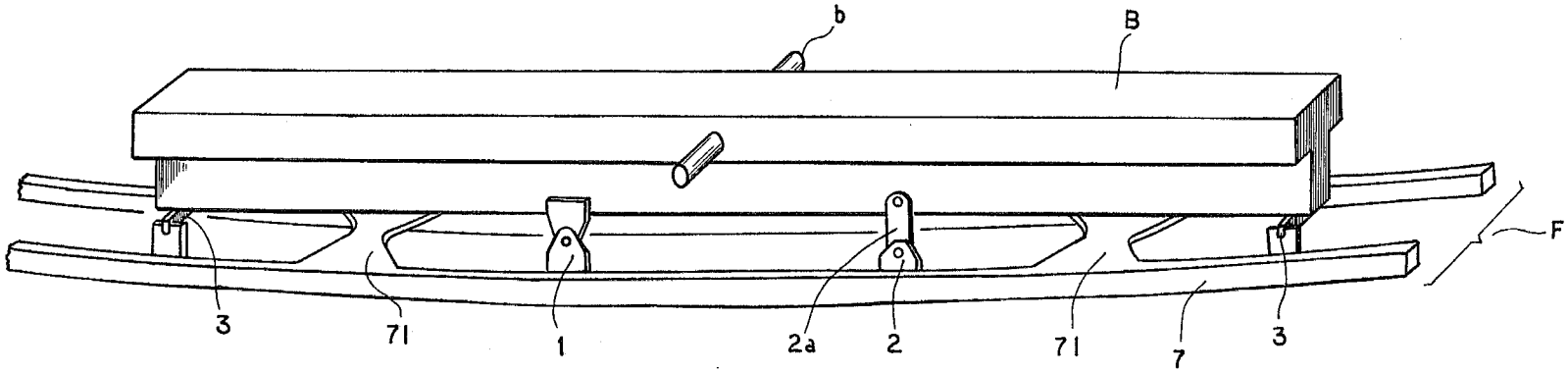
FIG. 2 is a perspective detail view, greatly enlarged by comparison to FIG. 1 of a guide beam for the rail system.

The connection of the rail F with the beam B will be readily apparent from FIG. 2. At the point 1 the beam B is swingable relative to the rail F but relative longitudinal displacement of the beam and the rail is not permitted. At location 2, a link 2*a* pivotally connects a beam with the rail so that pivotal movement and some linear relative movement between the beam and the rail is permissible. At both of its ends, the beam B bears against abutments 3 formed on the rail F.

Figure 3:
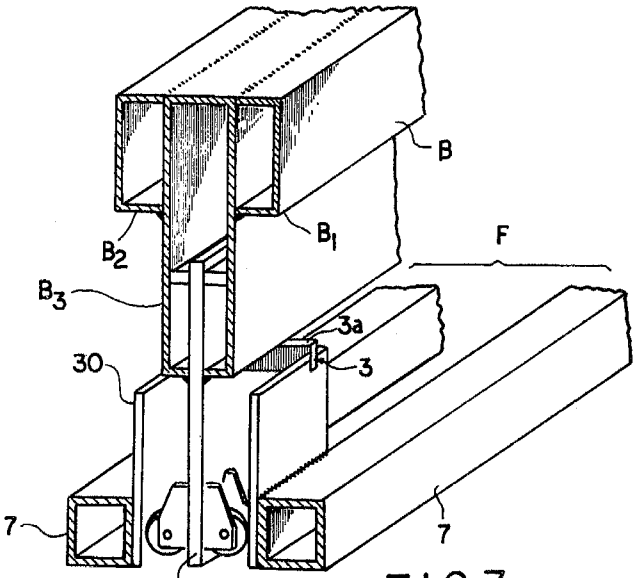
Figure 3A:
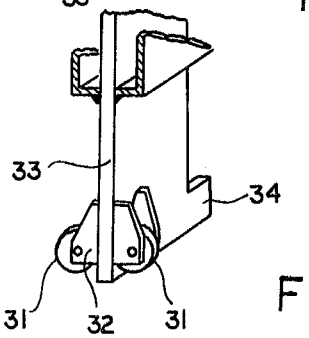

The abutments have been shown in greater detail in FIG. 3. Here the abutment has been illustrated as a blade 3*a* received in notches of a pair of plates 30 welded to the tubes 7.

Midway between the two plates 30, there is provided a plate 33 which is rigid with the beam B. Journals 32 rotatably receive a pair of rollers 31 rollingly engaging the inwardly facing cheeks formed by the plates 30. The plate 33 is so shaped that the abutment 3 passes freely relative to the plate 33 upon downward bowing of the rail until a foot 34 of the plate 33 engages the blade 3*a* from below.

In its unloaded state, the abutment blade 3*a*, as shown, lies directly below the guide beam B. As a vehicle arrives along the rail, its weight causes a downward tug on an upstream stretch of the rail F, thereby drawing the abutment away from the beam B in this region. Should excessive loading be present, and only upon such excess loading, the rail F is drawn downwardly sufficiently to enable the blade 3*a* to engage the foot 34. The guide rollers 31 maintain the beam member 33 parallel to the plates 30 even if lateral forces are applied to the beam.

Figure 5:
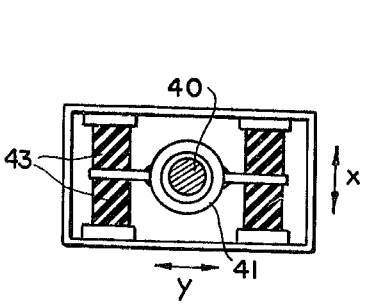
FIGS. 3, 3A, 4 and 5 are detail views also drawn to an enlarged scale and in partial or full cross section.
Figure 4:
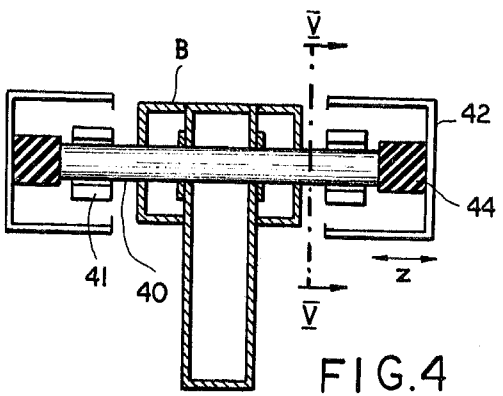

FIGS. 4 and 5 show the pivotal connection of the guide beam B with the support mast M. More particularly, FIG. 4 is a cross section through the pivotal connection while FIG. 5 is a section along the line V—V of FIG. 4.

The most important mobility or degree of freedom of movement of the beam B is its swingability about a horizontal axis perpendicular to the rail F. This degree of freedom is permitted by the pins 40, also designated as *b* in FIGS. 1 and 2. These are rotatable in bearing blocks or sleeves 41 and the bearing sleeves are held by elastic elements 43 (FIG. 5), of rubber, in the housing 42. The elements 43 are omitted in FIG. 4 for clarity, but FIG. 5 illustrates the manner in which the sleeves are supported. The housings 42 of each beam B are mounted on the respective support mast M.

The elastic (rubber) elements 43 (FIG. 5) permit the entire beam B to have limited movement in the upper and downward directions represented at x by a double-headed arrow. In addition, they also permit lateral movement (considered with respect to the pivotal axis) in the direction of the double headed arrow y. Elastic bumpers engaging the ends of the pins 40 permit only limited axial movement of pins 40 in the direction of the double headed arrow z.

Figure 6:
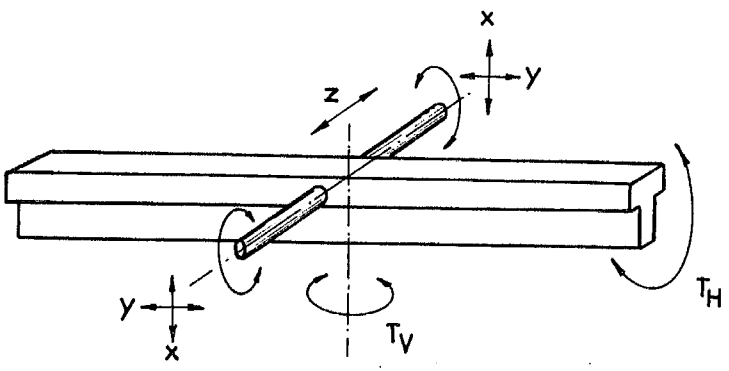
FIG. 6 is a diagrammatic illustration of the beam action.

Thus the beam B is permitted, apart from a purely pivotal movement about its axis, limited movement in at least three directions as has been represented at FIG. 6. This limited mobility includes:

(1) A lateral displacement of the beam transverse to itself and along the axis of the pins 40 as represented by the double-headed arrow z. The elastic (rubber) elements 44 limit the displacement in this direction and exercise restoring forces on the beam to position it midway between the elastic elements 44. This has been shown in FIG. 4.

(2) An upward and downward movement as represented by the two directions of the double-headed arrow x. This movement is limited by the elastic members 43 which center the axis of the pins 40 in the x direction.

(3) A torsion about a vertical axis as represented by the double-headed arrow $T_v$ in FIG. 6, this vertical axis being perpendicular to the axis of the pins 40 and to the rail F. Under such torsion, the elements 43 and 44 of one side of the pins are stressed in one direction y while the elastomeric elements on the opposite side are stressed in the other direction of the double-headed arrow y.

(4) A torsion about a horizontal axis as represented by the double-headed arrow $T_H$, the horizontal axis in question being the longitudinal axis of the beam B which is perpendicular to the first-mentioned torque axis and other pivot axis defined by the pins 40. With torsion of this type, the elements 43 on one side of the pins 40 are deformed in one of the x directions while the elastomeric elements on the opposite side are deformed in the other x direction.

If other degrees of freedom are desired, i.e. it is intended to permit the rail F to move out of its normal position in a particular direction, other elastomeric elements can be used to resist the displacement and restore the normal position. Considered together with the pivotal movement about the axis of the pins 40, the guide beam B has 5 degrees of freedom. This minimizes the stressing of the connection between the beam B and the support mast M. When lateral winds tend to force the vehicle to the side or minor rolling motions are applied to the vehicle, rigid attachments between the rail or beam and the mast generate very large reaction forces. In the system of the present invention deviations from the normal position are elastically transferred to the support mast and only reduced reaction forces are generated.

Figure 8:
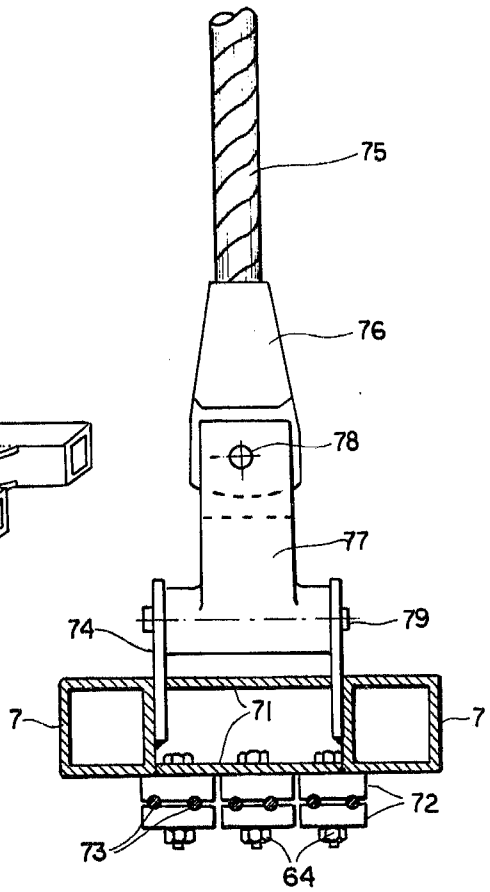
FIG. 8 is a detail view showing the connection of the rail to the suspending cable.
Figure 7:
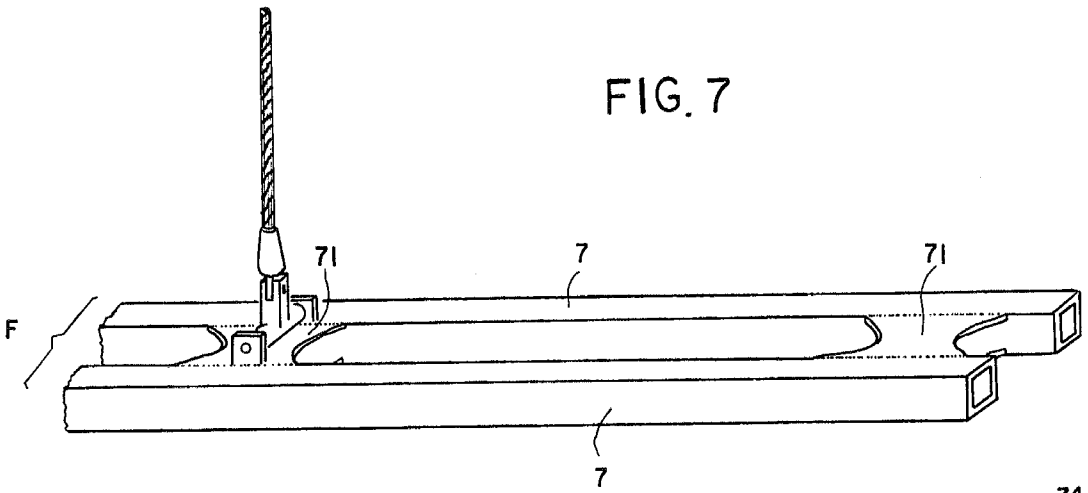
FIG. 7 is a detail view of a portion of the rail.

FIGS. 7 and 8 show several details of the rail F and its suspension between the masts M.

As has been previously described, the rail comprises two square-section tubes 7 which are held apart at a uniform distance by spacing webs 71 welded to the two tubes. This results in a rail of a high degree of stiffness. Additionally screws or bolts 64 as can be seen in FIG. 8 below the plates 71, mount clamping blocks 72 which clamp cables or wires 73 to the rail 70. These cables have been omitted in the illustrations of FIGS. 1, 2, 3 and 7 for the sake of clarity. These prestressed cables impart to the track additional stiffness both in the horizontal and in the vertical directions.

In the region of every second spacing plate 71, there are provided vertical lugs 74 which are welded into the confronting cheeks of the tube 7. The hangers of the suspender 75 engage these lugs 74 and thus support the track F from the suspension cable T. The hangers include a cable sleeve 76 and a T-shaped pivotal member 77. A first pin 78 pivotally connects the T-shaped member to the sleeve 76 and allows swinging movement about an axis parallel to the axis of the rail. One pin 79 pivotally connects the lug 74 to the T-shaped member 77. These pivotal connections preclude bending of the cables 77 and thus ensure only application of tension thereto.

We claim:

1. A suspended-track assembly for a monorail vehicle or the like which comprises:

at least two spaced-apart masts;

at least one suspension cable spanning said masts;

a plurality of suspenders secured to said cable and spaced apart therealong, said suspenders hanging downwardly from said cable;

a rail upon which said vehicle is adapted to ride connected between said masts, said rail being affixed to said suspenders and having an upwardly bowed configuration in an unloaded state;

respective guide beams pivotally connected to each of said masts and bearings upon said rail for rounding out the configuration thereof proximal to said masts, said beams each having a bearing pin, each mast being formed with a housing and a bearing block in said housing engaging the respective pin, said bearing block and said pin defining a pivotal axis perpendicular to the axis of said rail; and elastomeric means supporting said block in the respective housing for enabling 5 degrees of freedom of movement of said beam including:

(a) a lateral displacement of said guide beam parallel to the axis of said pin, (b) an upward and downward movement, (c) torsion about the longitudinal axis, (d) torsion about the vertical axis, and (e) pivotal movement about the axis of said pin.

2. The assembly defined in claim 1 wherein each of said beams is elongated and the pivot connecting same to said mast is located substantially at the center of the beam and the beam extends in two directions along said rail.

3. The assembly defined in claim 1 wherein said rail is formed by two parallel square-cross section metal tubes and longitudinally spaced-apart webs bridging said tubes and welded thereto, said suspenders being pivotally connected to at least some of said webs.

4. The assembly defined in claim 3 wherein each of said suspenders has a respective sleeve and a T-shaped body pivotally connected to said sleeve and articulated to said rail.

5. A suspended-track assembly for a monorail vehicle or the like which comprises:

at least two spaced-apart masts;

at least one suspension cable spanning said masts;

a plurality of suspenders secured to said cable and spaced apart therealong, said suspenders hanging downwardly from said cable;

a rail upon which said vehicle is adapted to ride connected between said masts, said rail being affixed to said suspenders and having an upwardly bowed configuration in an unloaded state;

respective guide beams pivotally connected to each of said masts and bearing upon said rail for rounding out the configuration thereof proximal to said masts, said beams each having a bearing pin, each mast being formed with a housing and a bearing block in said housing engaging the respective pin, said bearing block and said pin defining a pivotal axis perpendicular to the axis of said rail, each of said beam being elongated and the pivot connecting same to said mast being located substantially at the center of the beam and the beam extending in two directions along said rail; and respective abutments between said ends of said beam and juxtaposed portions of the rail effective in an upward direction and in a downward direction, respectively.

6. A suspended-track assembly for a monorail vehicle or the like which comprises:

at least two spaced-apart masts;

at least one suspension cable spanning said masts;

a plurality of suspenders secured to said cable and spaced apart therealong, said suspenders hanging downwardly from said cable;

a rail upon which said vehicle is adapted to ride connected between said masts, said rail being affixed to said suspenders and having an upwardly bowed configuration in an unloaded state;

respective guide beams pivotally connected to each of said masts and bearing upon said rail for rounding out the configuration thereof proximal to said masts, said beams each having a bearing pin, each mast being formed with a housing and a bearing block in said housing engaging the respective pin, said bearing block and said pin defining a pivotal axis perpendicular to the axis of said rail, each of said beams being elongated and the pivot connecting same to said mast being located substantially at the center of the beam and the beam extending in two directions along said rail; and abutment means between said ends of said beam and juxtaposed portions of the rail, said ends of said beam are provided with guides and said rail has complementary guides cooperating with the guides of said beam.

7. The assembly defined in claim 6 wherein said rail is formed by two parallel square-cross section metal tubes and longitudinally spaced-apart webs bridging said tubes and welded thereto, said suspenders being pivotally connected to at least some of said webs.

8. The assembly defined in claim 7 wherein each of said suspenders has a respective sleeve and a T-shaped body pivotally connected to said sleeve and articulated to said rail.

9. A suspended-track assembly for a monorail vehicle or the like which comprises:

at least two spaced-apart masts;

at least one suspension cable spanning said masts;

a plurality of suspenders secured to said cable and spaced apart therealong, said suspenders hanging downwardly from said cable;

a rail upon which said vehicle is adapted to ride connected between said masts, said rail being affixed to said suspenders and having an upwardly bowed configuration in an unloaded state; and respective guide beams pivotally connected to each of said masts and bearing upon said rail for rounding out the configuration thereof proximal to said masts, said beams each having a bearing pin, each mast being formed with a housing and a bearing block in said housing engaging the respective pin, said bearing block a and said pin defining a pivotal axis perpendicular to the axis of said rail, said rail being formed by two parallel square-cross section metal tubes and longitudinally spaced-apart webs bridging said tubes and welded thereto, said suspenders being pivotally connected to at least some of said webs, each of said beams having a T-cross section, and each of said beams being pivotally connected to said rail at at least two locations.

10. The assembly defined in claim 9 wherein each of said beams is elongated and the pivot connecting same to said mast is located substantially at the center of the beam and the beam extends in two directions along said rail.

* * * * *